US006302623B1

(12) United States Patent
Nellson

(10) Patent No.: US 6,302,623 B1
(45) Date of Patent: Oct. 16, 2001

(54) ROOF BOLTING APPARATUS

(75) Inventor: Brad Nellson, Gwynneville (AU)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 09/419,121

(22) Filed: Oct. 15, 1999

(51) Int. Cl.[7] ..... E21D 20/00; E21D 21/00

(52) U.S. Cl. ..... 405/259.1; 405/259.6; 405/288; 211/70

(58) Field of Search ..... 405/259.1, 259.5, 405/259.6, 288, 303; 211/70.4, 70

(56) References Cited

U.S. PATENT DOCUMENTS

| | | | | |
|---|---|---|---|---|
| 3,756,669 | | 9/1973 | Bucelluni . | |
| 4,076,337 | | 2/1978 | Childress . | |
| 4,215,953 | * | 8/1980 | Perraud | 405/303 |
| 4,226,559 | * | 10/1980 | Prebensen | 405/303 |
| 4,398,850 | * | 8/1983 | Talvensaari | 405/261 |
| 4,420,277 | * | 12/1983 | Hibbard et al. | 405/260 |
| 4,832,536 | * | 5/1989 | Spross et al. | 405/303 |
| 5,114,279 | * | 5/1992 | Bjerngren et al. | 405/303 |
| 5,165,825 | * | 11/1992 | Wallin | 405/303 |
| 5,556,235 | * | 9/1996 | Morrison et al. | 405/303 |
| 5,597,367 | * | 1/1997 | Trzmiel et al. | 474/110 |
| 6,135,674 | | 10/2000 | Neilson . | |

* cited by examiner

*Primary Examiner*—Thomas B. Will
*Assistant Examiner*—Alexandra K. Pechhold
(74) *Attorney, Agent, or Firm*—David R. Price

(57) ABSTRACT

A roof bolting apparatus comprising a frame, a rotary drive mounted on the frame for rotating a workpiece rod used in a mining operation, a timber jack rod supported by the frame, the timber jack rod having an upper end and having therein a hydraulic passage, a top plate mounted on the timber jack rod for movement therewith, the top plate having therein a hydraulic circuit communicating with the hydraulic passage in the timber jack rod, and first and second hydraulic cylinders movably mounted on the top plate, the cylinders communicating with the hydraulic circuit in the top plate, and each cylinder having an end defining a jaw, such that hydraulic fluid flow into the cylinders causes the ends of the cylinders to move toward each other, thereby causing the jaws to move together for holding the workpiece rod therebetween.

19 Claims, 2 Drawing Sheets

72
68
76
80
84
104
134
124
142
128
134
108
88
92
30
114
118
146
138
130
132
38
146
132
98
130
138
94
158
154
168
164
64
50
46
60
56

ROOF BOLTING APPARATUS

BACKGROUND OF THE INVENTION

The invention relates to roof bolting and drilling apparatus.

The roof bolting process involves at least seven different steps. A drill steel is loaded into a rotational drive or drilling unit, a rock surface is drilled, and the drill steel is removed from the rotational drive or drilling unit. Next, a chemical anchor is loaded into the bored hole, a roof bolt is loaded into the rotational drive or drilling unit, and the roof bolt is rotated so as to mix and thus set the chemical anchor. After the chemical anchor has been secured, a nut is tightened on the roof bolt.

U.S. Pat. Nos. 3,756,669 and 4,076,337 disclose roof bolting apparatus and devices for holding roof bolts or drill steel.

SUMMARY OF THE INVENTION

U.S. Pat. application Ser. No. 09/141,736, now U.S. Pat. No. 6,185,675 which is assigned to the assignee hereof, discloses a roof bolting apparatus including a top plate mounted on top of a timber jack. The top plate provides a U-shaped bight including a mechanical centralizer. The centralizer locates a rod or drill steel along the rotational axis of the rotational drive or drilling unit. The centralizer includes opposed yoke members or jaws which move together to surround the rod or drill steel and hold the rod relatively close to the rotational axis of the rotational drive unit. The jaws are moved toward and away from each other by respective hydraulic assemblies. Each hydraulic assembly includes a cylinder mounted on the top plate, and a piston rod having an outer end on which the associated jaw is mounted.

The present invention is an improvement of the centralizer disclosed in U.S. Ser. No. 09/141,736, now U.S. Pat. No. 6,135,674. The invention provides an integrated drill steel guide/hydraulic actuator which occupies minimal space. Two opposed, noncircular jaws move within slots in the top plate or head plate. A hydraulic actuator is integrated into each jaw, providing linear motion for extension and retraction. Placing the actuator inside the jaw provides spatial efficiency. All porting to provide hydraulic fluid to the actuators is bored internally within the head plate and the actuator rods. Lubrication is provided to the jaw running surfaces via leakage from the actuator when the jaw is retracted. This small leakage effectively lubricates and flushes the jaw running surfaces.

More particularly, the invention provides a roof bolting apparatus comprising a frame, a rotary drive mounted on the frame for rotating a workpiece rod used in a mining operation, a timber jack rod supported by the frame, the timber jack rod having an upper end and having therein a hydraulic passage, a top plate mounted on the timberjack rod for movement therewith, the top plate having therein a hydraulic circuit communicating with the hydraulic passage in the timber jack rod, and first and second hydraulic cylinders movably mounted on the top plate, the cylinders communicating with the hydraulic circuit in the top plate, and each cylinder having an end defining a jaw, such that hydraulic fluid flow into the cylinders causes the ends of the cylinders to move toward each other, thereby causing the jaws to move together for holding the workpiece rod therebetween.

The invention also provides a roof bolting apparatus comprising a frame having a lower end, a rotary drive mounted on the frame adjacent the lower end thereof for rotating a workpiece rod used in a mining operation, a timber jack rod supported by the frame for translational and longitudinal movement relative to the frame, the timber jack rod having an upper end and having therein a hydraulic passage with inlet and outlet ends, a top plate mounted on the upper end of the timber jack rod for movement therewith, the top plate having therein a hydraulic circuit communicating with the outlet end of the hydraulic passage in the timber jack rod, first and second opposing pistons fixed to the top plate by first and second piston rods, respectively, and first and second movable cylinders slidably mounted on the first and second pistons, respectively, such that each cylinder is divided by the associated piston into inner and outer chambers communicating with the hydraulic circuit in the top plate, each cylinder having an inner end through which the associated piston rod extends, and each cylinder having an outer end defining a jaw, such that hydraulic fluid flow into the outer chambers of the cylinders causes the outer ends of the cylinders to move toward each other, thereby causing the jaws to move together for holding the workpiece rod therebetween.

The invention also provides a roof bolting apparatus comprising a frame having upper and lower ends, a rotary drive mounted on the frame adjacent the lower end thereof for rotating a workpiece rod used in a mining operation, first and second timber jack rods supported by the frame for translational and longitudinal movement relative to the frame, each timber jack rod extending from the upper end of the frame, having an upper end and having therein a hydraulic passage with inlet and outlet ends, a top plate mounted on the upper end of the timber jack rod for movement therewith, the top plate having therein a hydraulic circuit communicating with the outlet ends of the hydraulic passages in the timber jack rods, and the top plate having therein first and second guide recesses, the guide recesses having respective inner walls, first and second opposing pistons fixed to the top plate by first and second piston rods, respectively, first and second cylinders housed in the first and second guide recesses, respectively, for linear movement relative to the top plate, the guide recesses and the cylinders having complementary non-circular shapes so as to prevent rotation of the cylinders relative to the top plate, the first and second cylinders being slidably mounted on the first and second pistons, respectively, such that each cylinder is divided by the associated piston into inner and outer chambers communicating with the hydraulic circuit in the top plate, each piston rod having therein hydraulic passages communicating between the hydraulic circuit and the chambers of the associated cylinder, each cylinder having an inner end through which the associated piston rod extends, and each cylinder having an outer end defining a jaw, such that hydraulic fluid flow into the outer chambers of the cylinders causes the outer ends of the cylinders to move toward each other, thereby causing the jaws to move together for holding the workpiece rod therebetween, and lubrication between the inner walls and the cylinders being provided by controlled leakage of hydraulic fluid from the cylinders.

A principal feature of the invention is the provision of an extremely compact centralizer that has a minimum number of components.

Another principal feature of the invention is a significant reduction of maintenance. The centralizer of the invention has very low wear rates.

Another principal feature of the invention is the provision of a centralizer with excellent drill steel centricity.

Other features and advantages of the invention will become apparent to those skilled in the art upon review of the following detailed description, claims and drawings.

Figure 1:
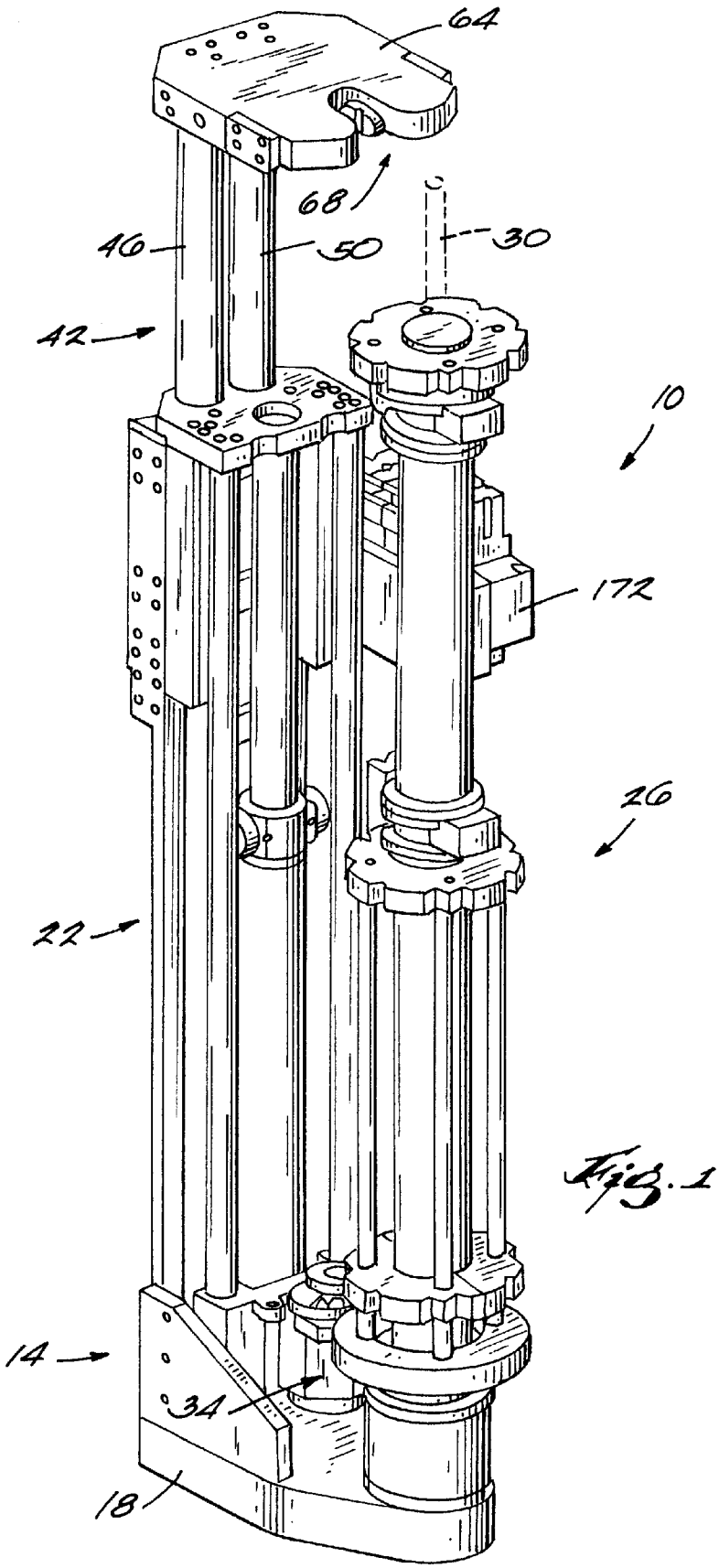
FIG. 1 is a perspective view of a roof bolting apparatus embodying the invention and including a top plate.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DESCRIPTION OF THE PREFERRED EMBODIMENT

A roof bolting apparatus 10 embodying the invention is illustrated in the drawings. Except as described below, the roof bolting apparatus 10 is substantially identical to the apparatus described in U.S. Ser. No. 09/141,736, which is incorporated herein by reference. The roof bolting apparatus 10 is also similar in many respects to the apparatus disclosed in U.S. patent application Ser. No. 908,464, which was filed Aug. 7, 1997, which is assigned to the assignee hereof, and which is incorporated herein by reference.

The roof bolting apparatus 10 comprises a frame 14 including a base plate 18. The base plate 18 supports a roof bolter 22 and a carousel 26. The carousel 26 stores and provides to the roof bolter 22 chemical anchors, roof bolts and drill steel (all of which are referred to herein as "rods"). One rod (identified by reference numeral 30) is shown in phantom in FIG. 1 and in solid lines in FIG. 2. The rods 30 are used for operations performed by the roof bolter 22 with respect to a rock formation to be stabilized.

Figure 2:
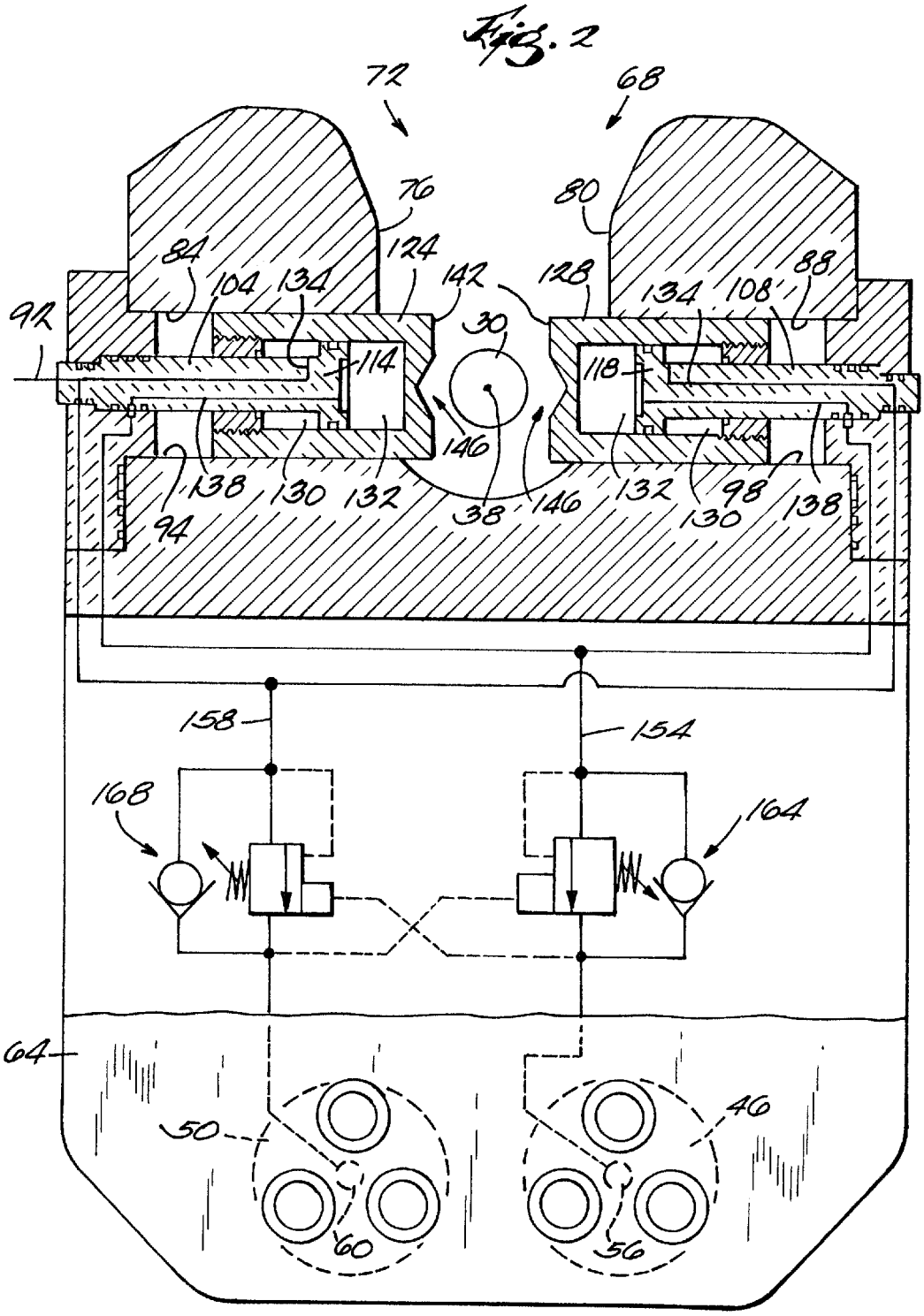
FIG. 2 is a partially schematic top plan view of the top plate partially broken away.

The roof bolter 22 includes a drilling unit or rotary drive unit 34 mounted on the base plate 18. The rotary drive unit 34 can be of any appropriate type including rotary only, percussive only, and rotary and percussive. As is known in the art, the rotary drive unit 34 rotates a rod about a generally vertical axis 38 (FIG. 2). The roof bolter 22 also includes a timber jack 42 having timber jack rods 46 and 50 which extend from the upper end of the frame 14 and which are supported for translational and longitudinal movement relative to the frame 14. The timber jack rods 46 and 50 have therein a respective longitudinally extending hydraulic passages 56 and 60 each with an inlet at the lower end of the rod and an outlet at the upper end of the rod. This arrangement is described in greater detail in U.S. Ser. No. 09/141,736.

A top plate 64 is mounted on the upper ends of the timber jack rods 46 and 50, such that the top plate 64 moves with the rods 46 and 50. The top plate 64 includes a centralizing mechanism 68, which is described below. The top plate 64 forms a U-shaped recess or bight 72 defined in part by opposed inner surfaces 76 and 80. As also explained below, the bight 72 receives a rod 30 being held by the centralizing mechanism 68. The centralizing mechanism 68 includes, in the top plate 64, guide recesses 84 and 88 in the inner surfaces 76 and 80, respectively. The guide recesses 84 and 88 are both centered on a generally horizontal axis 92 perpendicular to the rotational axis 38. The guide recesses 84 and 88 are noncircular and have respective inner walls 94 and 98.

The centralizing mechanism 68 also includes piston rods 104 and 108 fixed to the top plate 64 and extending into the guide recesses 84 and 88, respectively. The piston rods 104 and 108 have thereon respective pistons 114 and 118 located in the guide recesses 84 and 88, respectively. Cylinders 124 and 128 are respectively housed in the guide recesses 84 and 88 for linear movement relative to the top plate 64 along the axis 92. The cylinders 124 and 128 have non-circular shapes complementary to the guide recesses 84 and 88 so as to prevent rotation of the cylinders 124 and 128 relative to the top plate 64. The cylinders 124 and 128 are slidably mounted on the pistons 114 and 118, respectively, such that each cylinder is divided by the associated piston into inner and outer chambers 130 and 132, respectively. Each piston rod has therein a hydraulic passage 134 communicating with the associated inner chamber 130 and a hydraulic passage 138 communicating with the associated outer chamber 132. The passages 134 and 138 are shown schematically in FIG. 2.

The outer end of each cylinder defines a jaw 142 forming a V-shaped bight 146. It should be understood that the bight 146 can have any suitable configuration. Hydraulic fluid flow into the outer chambers 132 of the cylinders 124 and 128 causes the outer ends of the cylinders 124 and 128 to move toward each other, thereby causing the jaws 142 and the bights 146 to move together. The bights 146 then form an opening substantially centered on the rotational axis 38, so that the jaws 142 can center a rod 30 being driven by the rotary drive 34.

Lubrication between the inner walls 94 and 98 and the cylinders 124 and 128 is provided by controlled leakage of hydraulic fluid from the inner chambers 130 of the cylinders 124 and 128 during retraction of the cylinders. This leakage is provided by an intentionally imperfect seal between the cylinders 124 and 128 and the piston rods 104 and 108.

The centralizing mechanism 68 also includes, in the top plate 64, a hydraulic circuit 150 communicating between the outlet ends of the passages 56 and 60 and the passages 134 and 138 in the piston rods 104 and 108. The hydraulic circuit, which is shown schematically in FIG. 2, includes a hydraulic passage 154 communicating between the passage 56 and the passages 138 in the piston rods 104 and 108. The passage 154 thereby communicates with the outer chambers 132 of the cylinders 124 and 128. The hydraulic circuit 150 also includes a hydraulic passage 158 communicating between the passage 60 and the passages 134 in the piston rods 104 and 108. The passage 158 thereby communicates with the inner chambers 130 of the cylinders 124 and 128. The passages 154 and 158 have therein respective counterbalance valves 164 and 168, as is known in the art. A hydraulic control 172 (FIG. 1) mounted on the frame 14 controls the flow of hydraulic fluid to and from the passages 56 and 60 in the timber jack rods 46 and 50, and thereby controls the flow of fluid to the inner and outer chambers 130 and 132 of the cylinders 124 and 128. The control 172 thus extends and retracts the jaws 142 for centering a rod 30 on the axis 38. Any suitable hydraulic control, such as the one disclosed in U.S. Ser. No. 09/141,736, can be employed.

Various features of the invention are set forth in the following claims.

What is claimed is:

1. A roof bolting apparatus comprising a frame, a rotary drive mounted on the frame for rotating a workpiece rod used in a mining operation, a timber jack rod supported by the frame, the timber jack rod having an upper end and having therein a hydraulic passage, a top plate mounted on the timber jack rod for movement therewith, the top plate having therein a hydraulic circuit communicating with the hydraulic passage in the timber jack rod, and first and second guide recesses, and first and second hydraulic cylinders movably mounted on the top plate, said first cylinder being supported for movement relative to the top plate in said first guide recess, and said second cylinder being supported for movement relative to the top plate in said second guide recess, the cylinders communicating with the hydraulic circuit in the top plate, and each cylinder having an end defining a jaw, such that hydraulic fluid flow into the cylinders causes the ends of the cylinders to move toward each other, thereby causing the jaws to move together for holding the workpiece rod therebetween.

2. Apparatus as set forth in claim 1 and further comprising first and second opposing pistons fixed to the top plate, wherein the first and second cylinders are slidably mounted on the first and second pistons, respectively.

3. Apparatus as set forth in claim 2 wherein each piston divides the associated cylinder into inner and outer chambers, and wherein each piston rod has therein hydraulic passages communicating between the hydraulic circuit and the chambers of the associated cylinder.

4. Apparatus as set forth in claim 3 wherein hydraulic fluid flow into the outer chambers of the cylinders causes the ends of the cylinders to move toward each other.

5. Apparatus as set forth in claim 2 and further comprising first and second piston rods which are fixed to the top plate and on which the first and second pistons are respectively fixed.

6. Apparatus as set forth in claim 1 and further comprising a second timber jack rod which is supported by the frame and on which the top plate is mounted, the second timber jack rod having therein a hydraulic passage communicating with the hydraulic circuit in the top plate.

7. Apparatus as set forth in claim 6 and further comprising a hydraulic control communicating with the hydraulic passages in the timber jack rods for controlling the flow of hydraulic fluid to the cylinders.

8. Apparatus as set forth in claim 1 and further comprising a hydraulic control communicating with the hydraulic passage in the timber jack rod for controlling the flow of hydraulic fluid to the cylinders.

9. Apparatus as set forth in claim 1 wherein the guide recesses and the cylinders have complementary non-circular shapes so as to prevent rotation of the cylinders relative to the top plate, thereby maintaining proper orientation of the jaws.

10. Apparatus as set forth in claim 1 wherein the guide recesses have respective inner walls guiding the cylinders, and wherein lubrication between the inner walls and the cylinders is provided by controlled leakage of hydraulic fluid from the cylinders.

11. Apparatus as set forth in claim 1 wherein the apparatus has no flexible hydraulic conduits communicating with either the top plate or the cylinders.

12. A roof bolting apparatus comprising a frame having a lower end, a rotary drive mounted on the frame adjacent the lower end thereof for rotating a workpiece rod used in a mining operation, a timber jack rod supported by the frame for translational and longitudinal movement relative to the frame, the timberjack rod having an upper end and having therein a hydraulic passage with inlet and outlet ends, a top plate mounted on the upper end of the timber jack rod for movement therewith, the top plate having therein a hydraulic circuit communicating with the outlet end of the hydraulic passage in the timber jack rod, first and second opposing pistons fixed to the top plate by first and second piston rods, respectively, and first and second movable cylinders slidably mounted on the first and second pistons, respectively, such that each cylinder is divided by the associated piston into inner and outer chambers communicating with the hydraulic circuit in the top plate, each cylinder having an inner end through which the associated piston rod extends, and each cylinder having an outer end defining a jaw, such that hydraulic fluid flow into the outer chambers of the cylinders causes the outer ends of the cylinders to move toward each other, thereby causing the jaws to move together for holding the workpiece rod therebetween.

13. Apparatus as set forth in claim 12 wherein the top plate has therein first and second guide recesses in which the first and second cylinders are respectively supported for movement relative to the top plate.

14. Apparatus as set forth in claim 13 wherein the guide recesses and the cylinders have complementary non-circular shapes so as to prevent rotation of the cylinders relative to the top plate, thereby maintaining proper orientation of the jaws.

15. Apparatus as set forth in claim 13 wherein the guide recesses have respective inner walls guiding the cylinders, and wherein lubrication between the inner walls and the cylinders is provided by controlled leakage of hydraulic fluid from the cylinders.

16. Apparatus as set forth in claim 12 and further comprising a hydraulic control communicating with the inlet end of the hydraulic passage in the timber jack rod for controlling the flow of hydraulic fluid to the cylinders.

17. Apparatus as set forth in claim 12 wherein each piston rod has therein hydraulic passages communicating between the hydraulic circuit and the chambers of the associated cylinder.

18. Apparatus as set forth in claim 12 and further comprising a second timberjack rod which is supported by the frame and on which the top plate is mounted, the second timber jack rod having therein a hydraulic passage communicating with the hydraulic circuit in the top plate, and a hydraulic control communicating with the hydraulic passages in the timberjack rods for controlling the flow of hydraulic fluid to the cylinders.

19. A roof bolting apparatus comprising a frame having upper and lower ends, a rotary drive mounted on the frame adjacent the lower end thereof for rotating a workpiece rod used in a mining operation, first and second timber jack rods supported by the frame for translational and longitudinal movement relative to the frame, each timber jack rod extending from the upper end of the frame, having an upper end and having therein a hydraulic passage with inlet and outlet ends, a top plate mounted on the upper end of the timberjack rod for movement therewith, the top plate having therein a hydraulic circuit communicating with the outlet ends of the hydraulic passages in the timber jack rods, and the top plate having therein first and second guide recesses, the guide recesses having respective inner walls, first and second opposing pistons fixed to the top plate by first and second piston rods, respectively, first and second cylinders housed in the first and second guide recesses, respectively, for linear movement relative to the top plate, the guide recesses and the cylinders having complementary non-circular shapes so as to prevent rotation of the cylinders relative to the top plate, the first and second cylinders being slidably mounted on the first and second pistons, respectively, such that each cylinder is divided by the associated piston into inner and outer chambers communicating with the hydraulic circuit in the top plate, each piston rod having therein hydraulic passages communicating between the hydraulic circuit and the chambers of the associated cylinder, each cylinder having an inner end through which the associated piston rod extends, and each cylinder having an outer end defining a jaw, such that hydraulic fluid flow into the outer chambers of the cylinders causes the outer ends of the cylinders to move toward each other, thereby causing the jaws to move together for holding the workpiece rod therebetween, and lubrication between the inner walls and the cylinders being provided by controlled leakage of hydraulic fluid from the cylinders.

* * * * *